US010718568B2

(12) United States Patent
Nakamori

(10) Patent No.: US 10,718,568 B2
(45) **Date of Patent: *Jul. 21, 2020**

(54) SAMPLE HEATING DEVICE

(71) Applicant: SHIMADZU CORPORATION, Kyoto-shi, Kyoto (JP)

(72) Inventor: Akioki Nakamori, Nakagyo-ku (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 194 days.

This patent is subject to a terminal disclaimer.

(21) Appl. No.: 15/868,335

(22) Filed: Jan. 11, 2018

(65) Prior Publication Data

US 2018/0202718 A1 Jul. 19, 2018

(30) Foreign Application Priority Data

Jan. 17, 2017 (JP) ..... 2017-005610

(51) Int. Cl.
*F27D 5/00* (2006.01)
*F27B 9/22* (2006.01)
(Continued)

(52) U.S. Cl.
CPC ..... *F27D 5/00* (2013.01); *F27B 9/22* (2013.01); *F27B 9/30* (2013.01); *F27D 3/06* (2013.01)

(58) Field of Classification Search
CPC ..... F27D 5/00; F27D 3/06; F27B 9/22; F27B 9/30
See application file for complete search history.

(56) References Cited

U.S. PATENT DOCUMENTS 4,476,733 A * 10/1984 Chlosta ..... G01N 30/12 422/63
7,385,206 B2 * 6/2008 Motoi ..... G01N 1/32 250/306
(Continued)

FOREIGN PATENT DOCUMENTS

CN 205837952 U 12/2016
JP 9-21805 A 1/1997
(Continued)

OTHER PUBLICATIONS

Communication dated Nov. 15, 2019 from the Japanese Patent Office in application No. 2017-005610.
(Continued)

*Primary Examiner* — Jamel E Williams
(74) *Attorney, Agent, or Firm* — Sughrue Mion, PLLC

(57) ABSTRACT

A sample heating device includes: a rail-shaped disposal rail extending in one direction in a horizontal plane so that sample boats after heating are arranged and placed in a straight line; a disposal tray that houses the sample boat pushed-out from one end of the disposal rail; a sample boat conveying portion that places the sample boat after the heating at a predetermined placing position on the disposal rail; and a sample boat push-out portion that is positioned closer to the other end side of the disposal rail than the placing position when the sample boat is placed on the disposal rail and that is displaced toward the one end side of the disposal rail after the sample boat is placed at the placing position to slide the sample boats on the disposal rail toward the one end side.

7 Claims, 5 Drawing Sheets

(51) Int. Cl.
*F27B 9/30* (2006.01)
*F27D 3/06* (2006.01)

(56) References Cited

U.S. PATENT DOCUMENTS

| | | | | |
|---|---|---|---|---|
| 7,842,237 | B1 | 11/2010 | Shibuya et al. | |
| 10,371,448 | B2 * | 8/2019 | Nakamori ..... | G01N 1/44 |
| 2010/0248293 | A1 | 9/2010 | Kuwano et al. | |

FOREIGN PATENT DOCUMENTS

| | | | |
|---|---|---|---|
| JP | 2010-256325 | A | 11/2010 |
| JP | 2012-137337 | A | 7/2012 |
| JP | 2014-115172 | A | 6/2014 |
| JP | 2015-081784 | A | 4/2015 |
| JP | 201581784 | A | 4/2015 |
| WO | 01/51929 | A1 | 7/2001 |

OTHER PUBLICATIONS

Communication dated Apr. 20, 2020, from the State Intellectual Property of the P.R.C in application No. 201810039325.9.

* cited by examiner

SAMPLE HEATING DEVICE

BACKGROUND OF THE INVENTION

1. Field of the Invention

The present invention relates to a sample heating device in which a sample rested in a sample boat is inserted into a heating furnace and heated.

2. Description of the Related Art

There is a known sample heating device in which a liquid or solid sample is rested in a sample boat, placed in a heating furnace, and subjected to heating treatment (see Japanese Patent Application Laid-Open No. 2014-115172). Such a sample heating device is used, for example, for measurement of carbon components in the sample.

The sample heating device includes the heating furnace that heats the sample, a mounting port to which the sample boat to be subjected to the heating treatment in the heating furnace is mounted, and a sample moving bar that introduces the sample boat mounted to the mounting port into the heating furnace. Carrier gas is supplied into the heating furnace and components to be measured that are generated by heating of the sample in the heating furnace are introduced by the carrier gas into an analytical instrument.

A user of such a sample heating device opens a cover of the mounting port, mounts the sample boat to the mounting port, closes the cover of the mounting port, and then manually moves the sample moving bar to move the sample boat into the heating furnace. After the heating treatment is finished, the user manually moves the sample moving bar to move the sample boat to the mounting port, opens the cover of the mounting port, and takes out the sample boat.

As described above, in the prior-art sample heating device, the operations such as the mounting of the sample boat to the mounting port, the introduction of the sample boat into the heating furnace, and the taking out of the sample boat are carried out manually. In automation of such operations by use of a robotic arm and the like, it is conceivable to automate disposal of the heat-treated sample boat in a disposal position because the heat-treated sample boat is a waste sample.

However, the heat-treated sample boat needs to be checked in some cases after the heating treatment is finished. If the heat-treated sample boat is immediately disposed of in the disposal position, it becomes impossible to easily identify the sample boat to be checked. On the other hand, to keep all of the heat-treated sample boats undisposed of, a space for arranging and placing all of the heat-treated sample boats is necessary, which increases the entire device in size.

SUMMARY OF THE INVENTION

Therefore, it is an object of the present invention to provide a sample heating device including a structure that automatically disposes of a heat-treated sample boat and a structure that allows a user to easily check the heat-treated sample boat.

A sample heating device according to the present invention includes: a heating furnace that includes a space for housing a sample boat holding a sample to be heated and heats the sample held in the sample boat inserted into the space; a rail-shaped disposal rail extending in one direction in a horizontal plane so that sample boats after heating in the heating furnace are arranged and placed in a straight line; a disposal tray that is provided on one end side of the disposal rail and houses the sample boat pushed-out from one end of the disposal rail; a sample boat conveying portion that holds the sample boat after the heating in the heating furnace and places the sample boat at a placing position set at a position on the disposal rail at a distance longer than or equal to a length of the sample boat from the one end; and a sample boat push-out portion that is positioned closer to the other end side of the disposal rail than the placing position when the sample boat is placed on the disposal rail by the sample boat conveying portion and that is displaced on the disposal rail toward the one end side of the disposal rail after the sample boat is placed at the placing position to thereby slide the sample boats on the disposal rail toward the one end side.

According to a preferred aspect of the invention, the sample heating device further includes a moving mechanism that moves the disposal rail in the one direction, wherein a position of the sample boat push-out portion is fixed and the sample boat push-out portion is displaced on the disposal rail as a result of movement of the disposal rail in the one direction by the moving mechanism. With this structure, a mechanism for moving the sample boat push-out portion becomes unnecessary, which simplifies a device structure. Furthermore, because the disposal rail moves in the one direction, it is unnecessary to move the sample boat conveying portion in the same direction (one direction) as the direction of the movement of the disposal rail, which further simplifies the device structure.

In the above-described case, the moving mechanism is preferably formed to move the disposal rail in the one direction between a position for placement where the placing position is positioned closer to the one end side of the disposal rail than the sample boat push-out portion and a position for disposal where the placing position is positioned closer to the other end side of the disposal rail than the sample boat push-out portion. In this way, by only placing the heat-treated sample boat at the placing position in a state in which the disposal rail has been moved to the position for placement and then moving the disposal rail to the position for disposal, the sample boats placed on the disposal rail are automatically pushed out toward the one end side of the disposal rail by the sample boat push-out portion. By this operation, the sample boat that has reached the one end of the disposal rail is pushed out from the one end of the disposal rail and automatically housed into the disposal tray.

To achieve the above-described operation, the sample boat conveying portion is preferably formed to place the sample boat after the heating in the heating furnace when the disposal rail comes to the position for placement.

An example of the position for disposal is a position reached when the disposal rail moves by a distance corresponding to one sample boat toward the other end side of the disposal rail from a position where the sample boat push-out portion comes in contact with the sample boat for the first time after the sample boat is placed at the placing position. By setting the position for disposal at such a position, the sample boats placed on the disposal rail are pushed out one by one from the one end of the disposal rail into a port housing container as a result of the series of operations of the sample boat conveying portion and the disposal rail.

The sample heating device according to the invention preferably includes a sample boat rack on which the sample boat before the heating in the heating furnace is placed. In this case, the sample boat rack is preferably formed to be moved in the one direction together with the disposal rail by the moving mechanism. In this way, the mechanism for moving the sample boat rack is implemented by the mechanism for moving the disposal rail, which simplifies the device structure.

In the sample heating device according to the invention, the heat-treated sample boats are temporarily placed on the disposal rail and then disposed of into the disposal tray in sequence, and therefore, a user can easily check the heat-treated sample boats on the disposal rail. However, it may be necessary to check the sample boat after being disposed of into the disposal tray in some cases. In this case, the sample boats after being disposed of into the disposal tray are not lined up unlike the sample boats on the disposal rail, and therefore, it may be difficult to identify the sample boat which needs to be checked. Therefore, identification information that remains recognizable after the heating in the heating furnace is preferably attached to an outer face of the sample boat. In this way, it is possible to individually identify the sample boat housed in the disposal tray, which makes it easy to check the sample boat after being disposed of into the disposal tray.

The sample heating device according to the invention includes: the rail-shaped disposal rail extending in the one direction in the horizontal plane so that the heat-treated sample boats are arranged and placed in the straight line; the disposal tray that houses the sample boat pushed-out from the one end of the disposal rail; the sample boat conveying portion that places the heat-treated sample boat at the predetermined placing position on the disposal rail; and the sample boat push-out portion that is positioned closer to the other end side of the disposal rail than the placing position when the sample boat is placed on the disposal rail and that is displaced toward the one end side of the disposal rail after the sample boat is placed at the placing position to slide the sample boats on the disposal rail toward the one end side, and therefore, it is possible to automatically perform the operation for arranging the heat-treated sample boats in the straight line and placing the sample boats on the disposal rail and the operation for putting the sample boats on the disposal rail into the disposal tray in sequence. Because the heat-treated sample boats are arranged in the straight line and placed on the disposal rail, the user can easily check the heat-treated sample boats. Because the sample boats on the disposal rail are housed into the disposal tray in sequence, it is unnecessary to keep all of the heat-treated sample boats on the disposal rail, which suppresses increase in footprint.

DETAILED DESCRIPTION OF THE INVENTION

An embodiment of a sample heating device will be described below by using the drawings.

First, a structure of the sample heating device in the embodiment will be described.

In the embodiment, the sample boat is provided with a reference sign, 16, while a yet-to be-heat-treated sample boat 16 before heating treatment in a heating furnace 4 is described as sample boat 16*a*, and a heat-treated sample boat 16 after the heat treatment in the heating furnace 4 is described as sample boat 16*b*.

Figure 1:
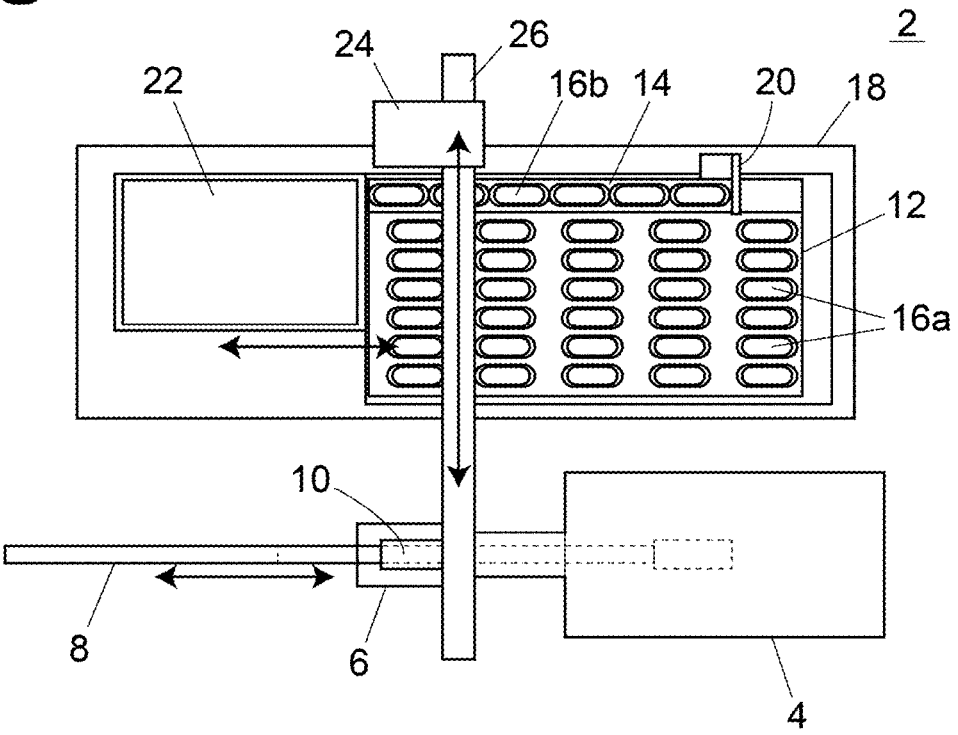
FIG. 1 is a plan view schematically showing a structure of an embodiment of a sample heating device.

As shown in FIG. 1, the sample heating device 2 of the embodiment is mainly formed by the heating furnace 4, a mounting port 6, a sample moving bar 8, a sample boat rack 12, a disposal tray 22, and a sample boat conveying portion 24. The sample boat rack 12 is a rack on which a plurality of sample boats 16*a* holding samples to be analyzed are arranged and placed. In the sample heating device 2 of the embodiment, the sample boat conveying portion 24 conveys the sample boat 16*a* placed on the sample boat rack 12 to the mounting port 6, and then, the sample moving bar 8 is driven to thereby introduce the sample boat 16*a* into the heating furnace 4. The heating treatment of the sample boat 16*a* is performed in the heating furnace 4, component gas to be measured that is generated in the heating treatment is led to an analytical instrument (not shown) communicating with the heating furnace 4, and the sample is analyzed.

The heating furnace 4 has within itself a space for housing the sample boat 16*a* and performs the heating treatment for the sample boat 16*a* by increasing a temperature in the space by use of a heater (not shown). The mounting port 6 is provided at a position away from the heating furnace 4 and communicates with the space inside the heating furnace 4. The sample moving bar 8 is formed to move in one direction (left-right direction in FIG. 1) in a horizontal plane, and a tip end side (right side in FIG. 1) of the sample moving bar 8 is provided in the mounting port 6. A holding portion 10 for holding the sample boat is provided to a tip end of the sample moving bar 8. The sample boat 16*a* is rested on the holding portion 10 at the tip end of the sample moving bar 8, and then, the sample boat 16*a* held by the holding portion 10 is introduced into the heating furnace 4 by movement of the sample moving bar 8 toward the heating furnace 4.

The sample boat rack 12 is provided beside the heating furnace 4 and the mounting port 6. The sample boat rack 12 is formed to move in one direction (left-right direction in FIG. 1) in the horizontal plane on a base 18.

Figure 2:
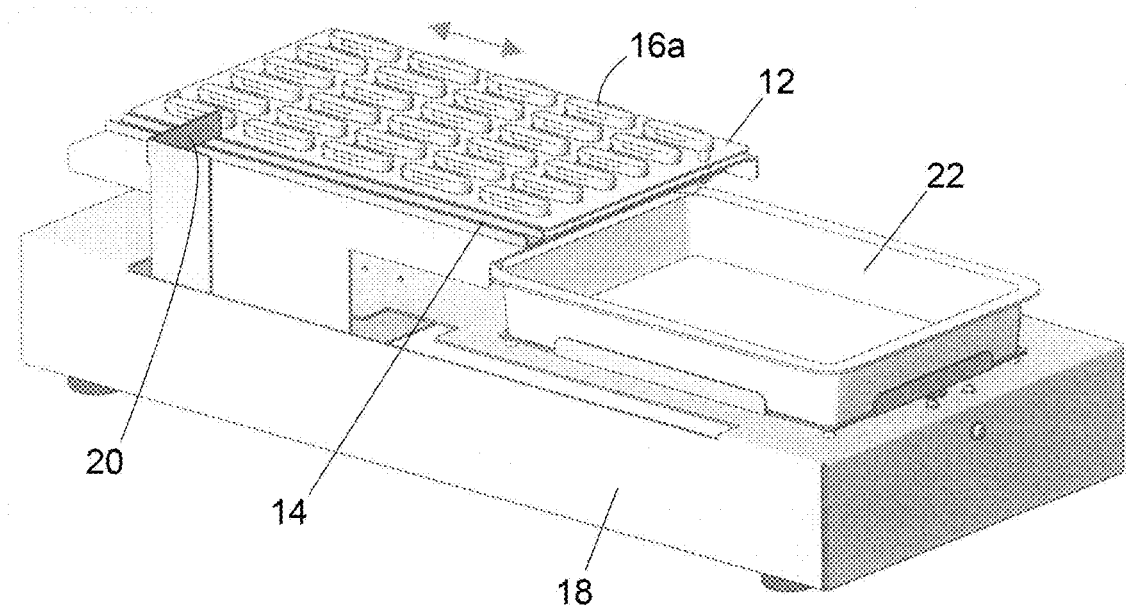
FIG. 2 is a perspective view showing a sliding table of the embodiment.

The sample boat rack 12 will be described by using FIG. 2 together with FIG. 1. The sample boat rack 12 includes a disposal rail 14, in addition to an area where the yet-to-be-heat-treated sample boats 16*a* are placed, for arranging and placing the heat-treated sample boats 16*b* in a straight line in a direction (left-right direction in FIG. 1) along a moving direction of the sample boat rack 12.

The disposal tray 22 is provided on one end side (left side in FIG. 1) of the disposal rail 14. The disposal tray 22 is a container for retrieving the sample boats 16*b* pushed out from one end of the disposal rail 14. In the sample heating device 2 of the embodiment, the heat-treated sample boats

16*b* are temporarily placed on the disposal rail 14 and then disposed of from the one end of the disposal rail 14 into the disposal tray 22 in sequence.

To achieve the operation for disposing of the sample boats 16*b* from the one end of the disposal rail 14 into the disposal tray 22 in sequence, a sample boat push-out portion 20 extending from a side of the sample boat rack 12 close to the disposal rail 14 so as to cross the disposal rail 14 is provided. The sample boat push-out portion 20 is formed by, for example, a plate-shaped member made of metal. The sample boat push-out portion 20 is attached to the base 18 and a position of the sample boat push-out portion 20 is fixed. The sample boat push-out portion 20 is provided at such a height as to interfere with the sample boat 16*b* placed on the disposal rail 14 and pushes out the sample boats 16*b* toward the one end side of the disposal rail 14 as the sample boat rack 12 moves from the one end side to the other end side (from the left side to the right side in FIG. 1).

Figure 4:
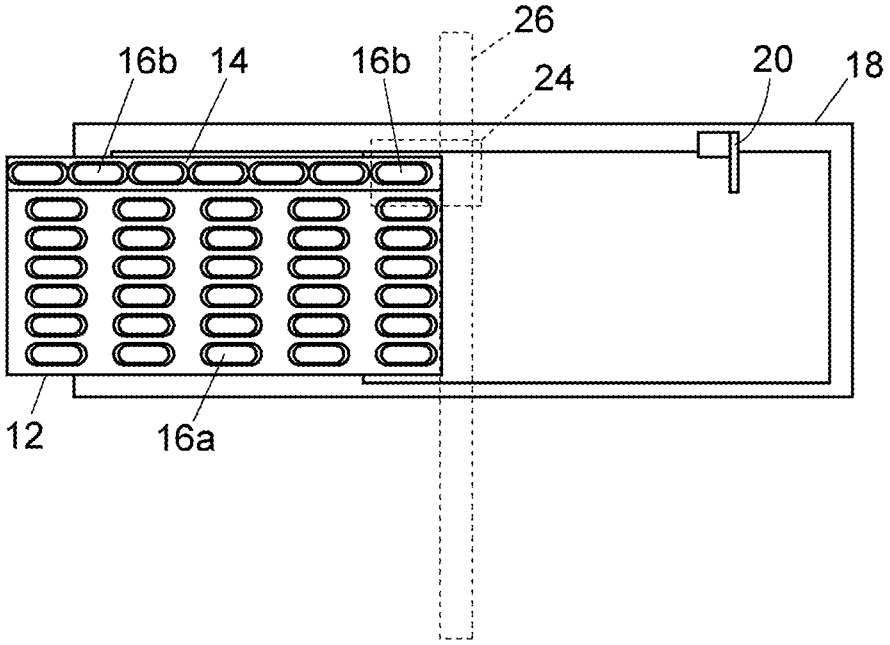
FIG. 4 is a plan view showing a state in which the sliding table of the embodiment has moved to a position for placement.

As positions of the sample boat rack 12 (disposal rail 14), a position for placement that is for placing the heat-treated sample boat 16*b* on the disposal rail 14 and a position for disposal that is for pushing out the sample boats 16*b* placed on the disposal rail 14 toward the one end side of the disposal rail 14 are set. FIG. 4 shows a state in which the sample boat rack 12 has moved to the position for placement and FIG. 6 shows a state in which the sample boat rack 12 has moved to the position for disposal.

In the sample heating device 2 of the embodiment, the most recently heat-treated sample boat 16*b* is placed on a position on the disposal rail 14 that closest to the other end side (right side in FIG. 4). In other words, the placing position for placing the heat-treated sample boat 16*b* is set at the closest position of the disposal rail 14 to the other end side. Therefore, when the sample boat conveying portion 24 places the heat-treated sample boat 16*b* on the disposal rail 14, the sample boat rack 12 is positioned so that the position of the disposal rail 14 closest to the other end side comes to a position under a moving path of the sample boat conveying portion 24. The position of the sample boat rack 12 at this time is the position for placement shown in FIG. 4.

Figure 6:
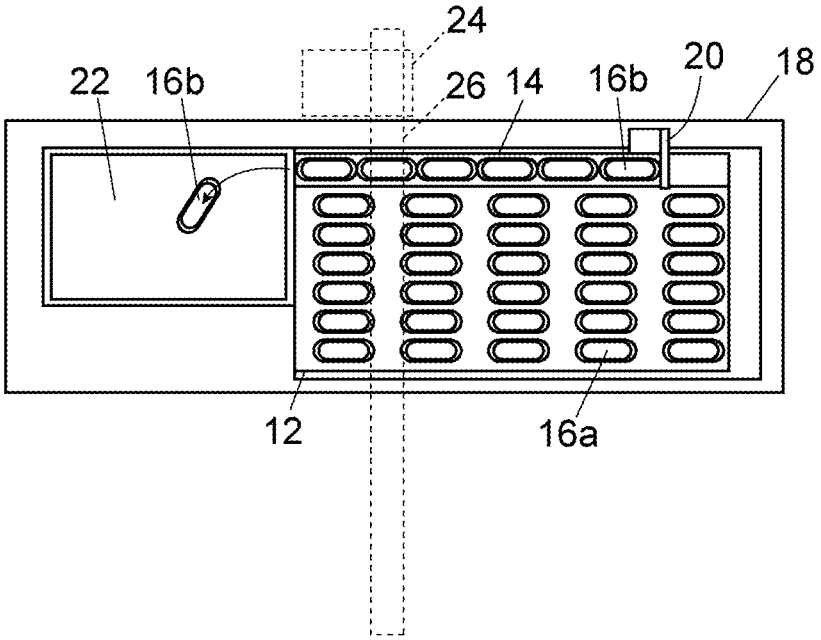
FIG. 6 is a plan view showing a state in which the sliding table of the embodiment has returned to the position for disposal.

After the sample boat 16*b* is placed at the placing position on the disposal rail 14 with the sample boat rack 12 having moved to the position for placement in FIG. 4, the sample boat rack 12 moves to the position for disposal in FIG. 6. The position for disposal is reached when the sample boat rack 12 moves toward the other end side and further moves by a distance corresponding to one sample boat 16*b* toward the other end side after the sample boat push-out portion 20 comes in contact with the sample boat 16*b* for the first time.

Figure 5:
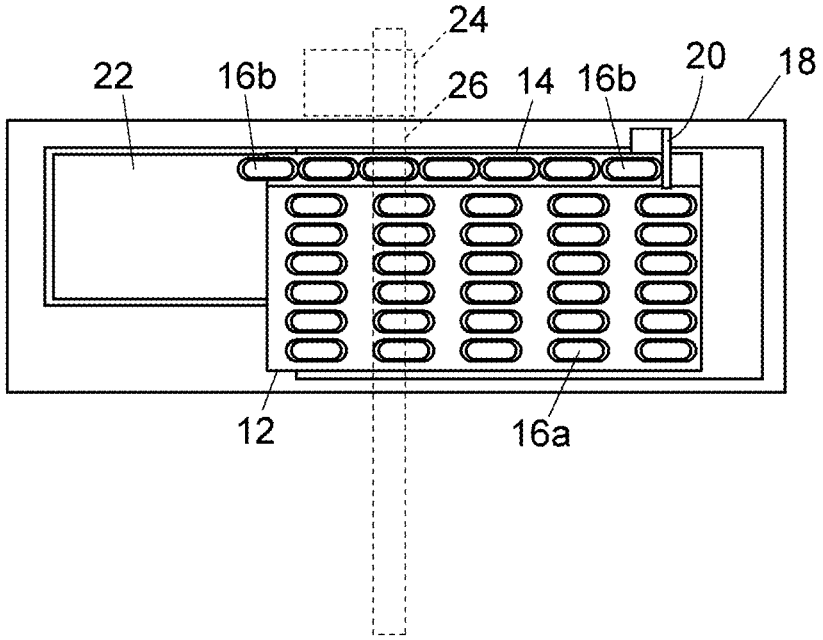
FIG. 5 is a plan view showing a state in which the sliding table of the embodiment is on its way back to a position for disposal.

In the process of movement of the sample boat rack 12 from the position for placement in FIG. 4 to the position for disposal in FIG. 6, the sample boats 16*b* on the disposal rail 14 are slid toward the one end side of the disposal rail 14 as shown in FIG. 5. This operation creates a placing space corresponding to one sample boat 16*b* at the position on the disposal rail 14 closest to the other end side (placing position), and a new heat-treated sample boat 16*b* can be placed in the space when the sample boat rack 12 moves to the position for placement next time. By repeating the operation, the heat-treated sample boats 16*b* are sequentially arranged and placed in the straight line on the disposal rail 14.

In the embodiment, the disposal rail 14 has such a length that the six sample boats 16*b* are placed on the disposal rail 14 when the sample boat rack 12 comes to the position for disposal in FIG. 6. If the new sample boat 16*b* is placed on the disposal rail 14 when the six sample boats 16*b* are placed on the disposal rail 14, the sample boat 16*b* closest to the one end side (left side in FIGS. 4, 5, and 6) of the disposal rail 14 is pushed out from the one end of the disposal rail 14 and falls into the disposal tray 22 in the process of movement of the sample boat rack 12 from the position for placement shown in FIG. 4 to the position for disposal in FIG. 6.

On this principle, the heat-treated sample boat 16*b* is temporarily placed on the disposal rail 14 so that a user can easily check the heat-treated sample boat 16*b*. When the heat-treated sample boat 16*b* comes to the position on the disposal rail 14 closest to the one end side, the sample boat 16*b* is automatically disposed of into the disposal tray 22 as the sample boat rack 12 moves.

Although the disposal rail 14 preferably has such a length that the plurality of sample boats 16*b* are placed on the disposal rail 14 when the sample boat rack 12 has moved to the position for disposal (see FIG. 6), the number of sample boats 16*b* that can be placed on the disposal rail 14 may be any number.

Although the sample boats 16*b* on the disposal rail 14 are disposed of one by one into the disposal tray 22 in the above description, two or more sample boats 16*b* may be disposed of into the disposal tray 22 at the same time.

Figure 8:
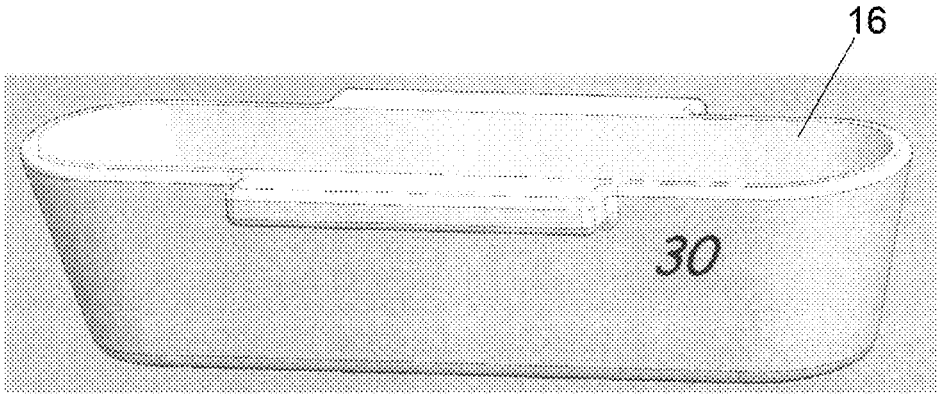
FIG. 8 is a perspective view showing an example of a sample boat handled in the sample heating device of the embodiment.

Here, the sample boat 16*b* after falling into the disposal tray 22 needs to be checked in some cases. In this case, if many sample boats 16*b* are in the disposal tray 22, it is difficult to identify the sample boat 16*b* that the user wants to check. Therefore, as shown in FIG. 8, identification information for identifying each sample boat 16 is attached to an outer face of the sample boat 16. Although an individual number is attached as the identification information in the embodiment, any identification information based on which each sample boat 16*b* can be identified may be employed. Because the sample boat 16 is heated at a high temperature in the heating furnace 4, it is important for the identification information not to lose its function as the identification information even after the heating in the heating furnace 4. Therefore, in attaching the number or the like to the outer face of the sample boat 16 as shown in FIG. 8, inorganic ink and the like which does not vaporize and disappear even after the heating at the high temperature may be used.

Referring back to FIG. 1, the description of the structure of the sample heating device 2 will be continued. The sample boat conveying portion 24 is provided to move along a guide rail 26 extending in the horizontal direction orthogonal to a moving direction of the sample boat rack 12 above the mounting port 6 and sample boat rack 12. The sample boat conveying portion 24 includes a handler (not shown) for holding the sample boat 16 (16*a* or 16*b*) and can drive the handler in a vertical direction.

Figure 3:
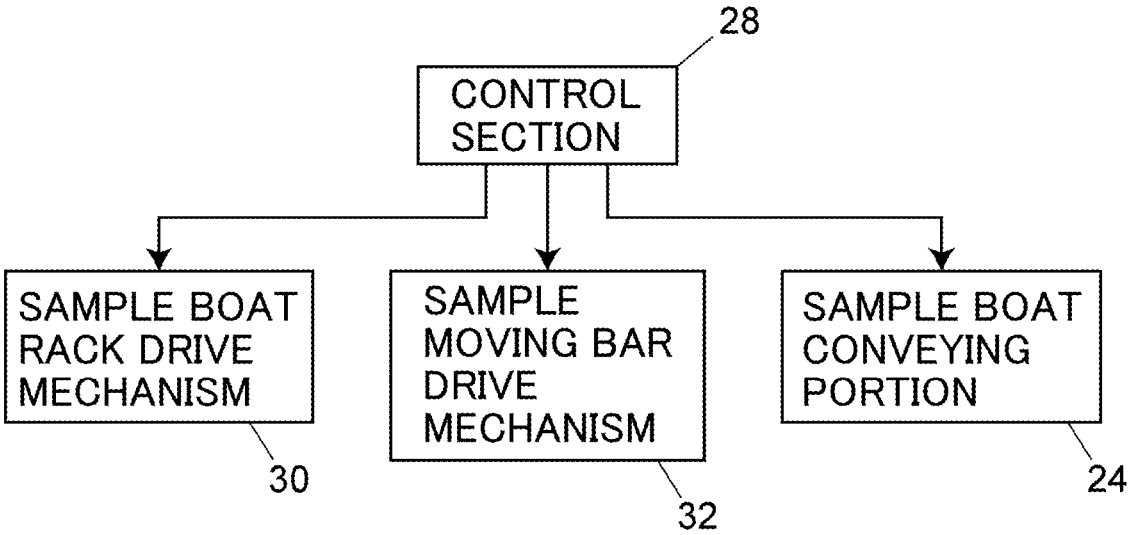
FIG. 3 is a block diagram schematically showing a control system of the embodiment.

As shown in FIG. 3, an operation of the sample boat conveying portion 24, an operation of a sample boat rack drive mechanism 30 (moving mechanism) that drives the sample boat rack 12, and an operation of a sample moving bar drive mechanism 32 that drives the sample moving bar 8 are controlled by a common control section 28. The control section 28 can be implemented by a dedicated computer provided to the sample heating device 2 or a general-purpose personal computer electrically connected to the sample heating device 2.

Figure 7:
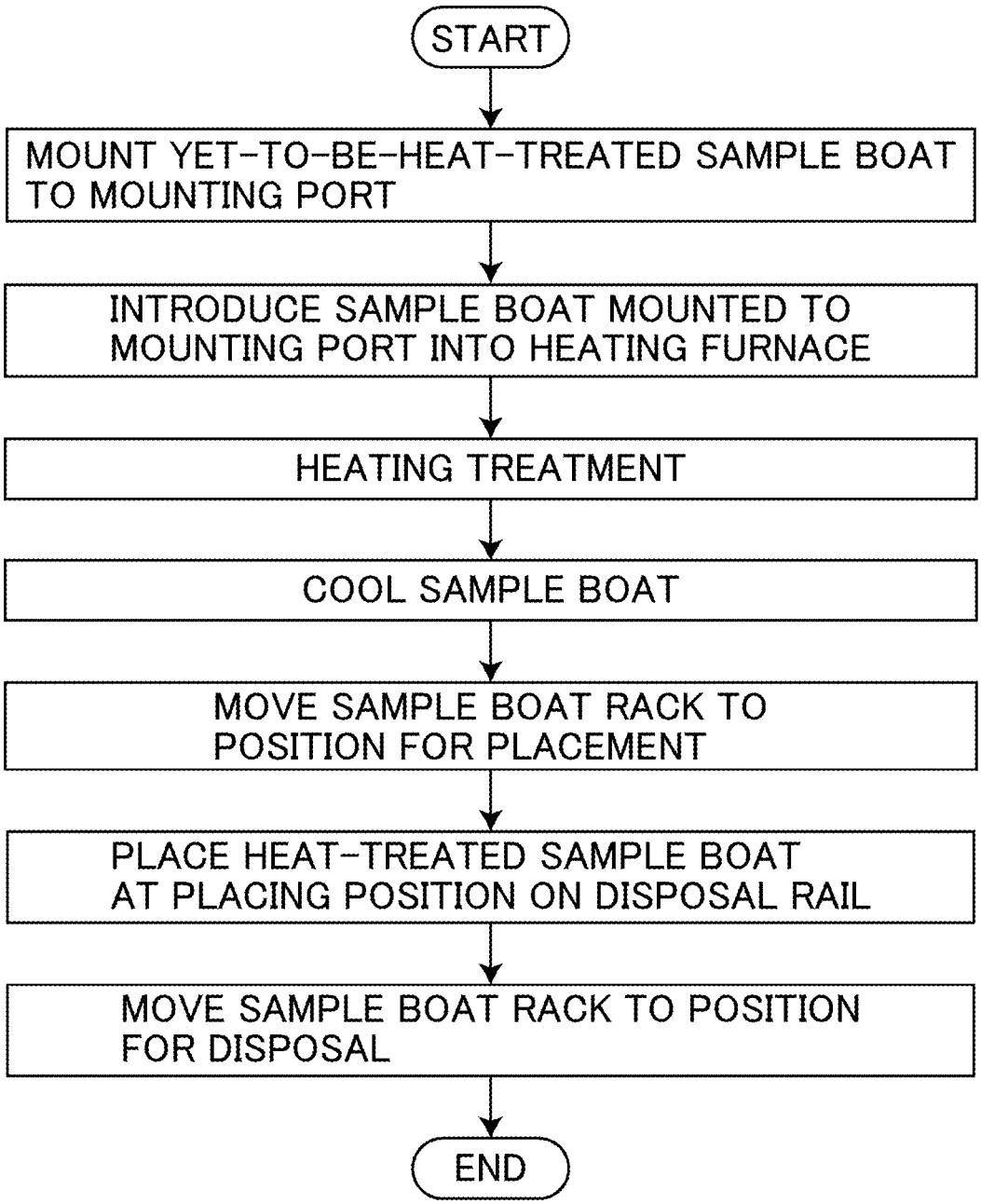
FIG. 7 is a flowchart showing an example of an operation of the sample heating device of the embodiment.

An example of the operation of the sample heating device 2 of the embodiment will be described by using FIGS. 4 to 6 together with a flowchart in FIG. 7.

First, to mount the yet-to-be-heat-treated sample boat 16*a* to the mounting port 6, the sample boat rack 12 is moved so that the target sample boat 16*a* comes to a position under the moving path of the sample boat conveying portion 24, and the sample boat conveying portion 24 holds the target sample boat 16*a* and conveys the sample boat 16*a* to the mounting port 6. At this time, the holding portion 10 at the tip end of the sample moving bar 8 is placed at the mounting port 6.

After the sample boat 16*a* is rested on the holding portion 10 at the mounting port 6, the sample moving bar 8 is moved toward the heating furnace 4 to introduce the sample boat 16*a* into the heating furnace 4, and the heating treatment for the sample boat 16*a* is performed. After the heating treatment is finished, the sample moving bar 8 is moved toward the mounting port 6 to put the heat-treated sample boat 16*b* on standby for a certain period of time at a position outside the heating furnace 4 to thereby cool the sample boat 16*b*.

After the cooling of the heat-treated sample boat 16*b* is finished, the sample boat rack 12 is moved to the position for placement (see FIG. 4), and the sample boat 16*b* is placed at the placing position on the disposal rail 14. Then, the sample boat rack 12 is moved to the position for disposal (see FIG. 6). The above-described operation is performed for every yet-to-be-heat-treated sample boat 16*a* placed on the sample boat rack 12.

The sample boat rack 12 (disposal rail 14) is formed to move in the one direction in the horizontal plane, and the position of the sample boat push-out portion 20 is fixed in the above-described embodiment. Alternatively, a position of a sample boat rack 12 may be fixed, and a sample boat push-out portion 20 may be formed to move in one direction. In short, it is essential only that the disposal rail 14 and the sample boat push-out portion 20 be formed to move in one direction in the horizontal plane with respect to each other.

What is claimed is:

1. A sample heating device comprising:

a heating furnace that includes a space for housing a sample boat holding a sample to be heated and heats the sample held in the sample boat inserted into the space;

a rail-shaped disposal rail extending in one direction in a horizontal plane so that sample boats after heating in the heating furnace are arranged and placed in a straight line;

a disposal tray that is provided on one end side of the disposal rail and houses the sample boat pushed-out from one end of the disposal rail;

a sample boat conveying portion that holds the sample boat after the heating in the heating furnace and places the sample boat at a placing position set at a position on the disposal rail at a distance longer than or equal to a length of the sample boat from the one end; and a sample boat push-out portion that is positioned closer to the other end side of the disposal rail than the placing position when the sample boat is placed on the disposal rail by the sample boat conveying portion and that is displaced on the disposal rail toward the one end side of the disposal rail after the sample boat is placed at the placing position to thereby slide the sample boats on the disposal rail toward the one end side.

2. The sample heating device according to claim 1 further comprising a moving mechanism that moves the disposal rail in the one direction, wherein a position of the sample boat push-out portion is fixed and the sample boat push-out portion is displaced on the disposal rail as a result of movement of the disposal rail in the one direction by the moving mechanism.

3. The sample heating device according to claim 2, wherein the moving mechanism is formed to move the disposal rail in the one direction between a position for placement where the placing position is positioned closer to the one end side of the disposal rail than the sample boat push-out portion and a position for disposal where the placing position is positioned closer to the other end side of the disposal rail than the sample boat push-out portion.

4. The sample heating device according to claim 3, wherein the sample boat conveying portion is formed to place the sample boat after the heating in the heating furnace when the disposal rail comes to the position for placement.

5. The sample heating device according to claim 4, wherein the position for disposal is reached when the disposal rail moves by a distance corresponding to one sample boat toward the other end side of the disposal rail from a position where the sample boat push-out portion comes in contact with the sample boat for the first time after the sample boat is placed at the placing position.

6. The sample heating device according to claim 2 further comprising a sample boat rack on which the sample boat before the heating in the heating furnace is placed, wherein the sample boat rack is formed to be moved in the one direction together with the disposal rail by the moving mechanism.

7. The sample heating device according to claim 1, wherein identification information that remains recognizable after the heating in the heating furnace is attached to an outer face of the sample boat.

* * * * *